US009651260B2

(12) United States Patent
Sandelis et al.

(10) Patent No.: US 9,651,260 B2
(45) Date of Patent: May 16, 2017

(54) ANNULAR COMBUSTION CHAMBER FOR A TURBINE ENGINE

(71) Applicant: SNECMA, Paris (FR)

(72) Inventors: Denis Jean Maurice Sandelis, Nangis (FR); Christophe Pieussergues, Nangis (FR)

(73) Assignee: SNECMA, Paris (FR)

( * ) Notice: Subject to any disclaimer, the term of this patent is extended or adjusted under 35 U.S.C. 154(b) by 530 days.

(21) Appl. No.: 14/344,266

(22) PCT Filed: Sep. 20, 2012

(86) PCT No.: PCT/FR2012/052098

§ 371 (c)(1),
(2) Date: Mar. 11, 2014

(87) PCT Pub. No.: WO2013/045792

PCT Pub. Date: Apr. 4, 2013

(65) Prior Publication Data

US 2015/0040569 A1 Feb. 12, 2015

(30) Foreign Application Priority Data

Sep. 27, 2011 (FR) ..... 11 58655

(51) Int. Cl.
*F23R 3/28* (2006.01)
*F23R 3/06* (2006.01)
(Continued)

(52) U.S. Cl.
CPC ..... *F23R 3/286* (2013.01); *F23R 3/002* (2013.01); *F23R 3/06* (2013.01); *F23R 3/12* (2013.01); *F23R 3/50* (2013.01)

(58) Field of Classification Search
CPC .. F23R 3/286; F23R 3/002; F23R 3/06; F23R 3/04; F23R 3/12
See application file for complete search history.

(56) References Cited

U.S. PATENT DOCUMENTS 4,696,157 A 9/1987 Barbier et al.
2007/0269757 A1* 11/2007 Commaret ..... F23R 3/10 431/265

(Continued)

FOREIGN PATENT DOCUMENTS

FR 2 588 919 4/1987
FR 2 901 349 11/2007

OTHER PUBLICATIONS

International Search Report Issued Aug. 23, 2013 in PCT/FR12/052098 Filed Sep. 20, 2012.

*Primary Examiner* — Andrew Nguyen
(74) *Attorney, Agent, or Firm* — Oblon, McClelland, Maier & Neustadt, L.L.P.

(57) ABSTRACT

An annular combustion chamber including inner and outer walls forming surfaces of revolution that are connected together upstream by an annular chamber end wall having injection systems passing therethrough. Each injection system includes at least one swirler for producing a rotating stream of air downstream from a fuel injector, and a frustoconical bowl downstream from the swirler and formed with an annular row of air injection orifices, the outer wall having an annular row of primary dilution orifices. The orifices of the bowls are distributed and dimensioned such that sheets of air/fuel mixture present a local enlargement circumferentially intersecting an adjacent sheet of fuel upstream from the primary dilution orifices.

10 Claims, 5 Drawing Sheets

(51) Int. Cl.

| | |
|---|---|
| ***F23R 3/12*** | (2006.01) |
| ***F23R 3/50*** | (2006.01) |
| ***F23R 3/00*** | (2006.01) |

(56) References Cited

U.S. PATENT DOCUMENTS

| | | | | |
|---|---|---|---|---|
| 2008/0173019 | A1* | 7/2008 | Kobayashi | F23R 3/343<br>60/739 |
| 2010/0077763 | A1 | 4/2010 | Alkabie | |
| 2011/0185736 | A1* | 8/2011 | McKinney | F23R 3/06<br>60/752 |

* cited by examiner

ANNULAR COMBUSTION CHAMBER FOR A TURBINE ENGINE

BACKGROUND OF THE INVENTION

Field of the Invention

The present invention relates to an annular combustion chamber for a turbine engine such as an airplane turbojet or turboprop.

Description of the Related Art

In known manner, an annular combustion chamber for a turbine engine receives upstream a stream of air from a high pressure compressor, and delivers downstream a stream of hot gas for driving the rotors of high-pressure and low-pressure turbines.

An annular combustion chamber comprises two coaxial walls forming surfaces of revolution extending one inside the other and connected together at their upstream ends by an annular chamber end wall, the chamber end wall having openings for mounting fuel injection systems between the inner and outer coaxial walls.

Each injection system includes means for supporting the head of a fuel injector and at least one swirler that is arranged downstream from the head of the injector, on the same axis, and that delivers a rotating stream of air downstream from the injection of fuel so as to form a mixture of air and of fuel that is to be burnt in the combustion chamber.

The swirlers of injection systems are fed with air coming from an annular diffuser mounted at the outlet from the high-pressure compressor arranged upstream from the combustion chamber.

Each swirler leads downstream to the inside of a mixer bowl having a substantially frustoconical downstream wall that flares downstream and that includes a row of air injection orifices that are regularly distributed around the axis of the bowl.

The outer coaxial wall of the combustion chamber has an annular row of primary dilution orifices and at least one spark plug leading to the inside of the combustion chamber and arranged downstream from the primary dilution orifices.

In operation, air leaving the high-pressure compressor flows inside each of the injection systems. The air/fuel mixture is ejected from each injection system so as to form a sheet of air and of fuel that is substantially frustoconical, flaring downstream. The aperture angle of the sheet is a function of the aperture angle of the frustoconical wall of the mixer bowl and of the dimensions of the air injection orifices formed in said frustoconical wall. Thus, the greater the diameter of the orifices in the mixer wall, the greater the flow rate of air passing through each of the orifices, and the less the extent to which the sheet of air/fuel mixture flares.

The primary dilution orifices serve to stabilize the combustion flame in the end of the chamber, and by diluting the air/fuel mixture they prevent the combustion flame from separating and penetrating into the high pressure turbine and damaging components, such as specifically stator vanes, by forming hot points thereon.

In practice, injection systems are configured so that for each injection system, the air/fuel mixture sheet crosses or intersects circumferentially the fuel sheets of the two adjacent injection systems, and does so upstream from the dilution orifices. This ensures circumferential continuity of the air/fuel mixture between the injection systems prior to dilution, thereby serving to guarantee that the flame ignited by the spark plug(s) propagates all around the circumference of the combustion chamber.

In certain configurations, in particular in so-called converging combustion chambers in which the outer and inner coaxial walls are frustoconical walls of section that taper downstream, or when the number of injection systems is small, the circumferential pitch between adjacent injection systems is greater. As a result the sheets of fuel from adjacent injection systems no longer intersect circumferentially upstream from the primary dilution orifices, thereby giving rise to difficulties in propagating the flame circumferentially between the injectors, and thus reducing the performance of the combustion chamber.

In order to mitigate that drawback, it is not desirable to increase the number of injectors, since that would lead to making the turbine engine heavier. Increasing the aperture angle of the sheets of fuel is also unsatisfactory, since that would lead to projecting a larger quantity of fuel towards the inner and outer coaxial walls and to forming hot points on the inner and outer coaxial walls.

BRIEF SUMMARY OF THE INVENTION

A particular object of the invention is to provide a simple, inexpensive, and effective solution to the above-mentioned problems, making it possible to avoid the drawbacks of the prior art.

To this end, the invention provides an annular combustion chamber comprising two coaxial walls forming surfaces of revolution, respectively an inner wall and an outer wall, the walls being connected together at their upstream end by an annular chamber end wall having openings for mounting injection systems, each comprising at least one swirler for producing a rotating stream of air downstream from a fuel injector, and a bowl having a substantially frustoconical wall downstream from the swirler and formed with an annular row of air injection orifices for producing a substantially frustoconical and rotating sheet of a mixture of air and of fuel, the outer wall having an annular row of primary dilution orifices, the combustion chamber being characterized in that the orifices of the bowls are distributed and dimensioned in such a manner that at least some of the sheets of air/fuel mixture present at least one local enlargement circumferentially intersecting an adjacent fuel sheet upstream from the primary dilution orifices.

The invention makes it possible to conserve the same angular aperture angle for the sheets of fuel while modifying some of the bowls so as to form a local enlargement of their respective fuel sheets, such a local enlargement circumferentially intersecting the air/fuel mixture sheet of an adjacent injection system upstream from the primary dilution orifices.

It is thus possible to guarantee circumferential continuity of the air/fuel mixture prior to air being introduced via the primary dilution orifices, thereby ensuring good circumferential propagation of the combustion flame without adding additional injectors.

In a first embodiment of the invention, the orifices of the bowls are regularly distributed around the axes of the bowls, and some of the orifices in some of the bowls are smaller in diameter than the other orifices of said bowls, the smaller-diameter orifices being formed over an angular sector of size and angular position that are predetermined so as to form a local enlargement of the sheet of fuel.

Having orifices of smaller diameter over a given sector of some of the bowls makes it possible to reduce the flow rate of air passing through those orifices. The air leaving those orifices therefore has a smaller impact on the air/fuel mixture coming from the upstream swirler, thus leading to a local increase in the ejection angle of the air/fuel mixture and forming a local enlargement of the fuel sheet.

According to another characteristic of the invention, the orifices of the above-mentioned angular sector of each above-mentioned bowl have a diameter that is at least 40% smaller than the diameter of the other orifices of the bowl.

In a second embodiment of the invention, at least some of the bowls have no orifices over an angular sector of size and angular position that are predetermined so as to form the local enlargement of the sheet of fuel.

Eliminating orifices through the frustoconical wall of the bowl over a sector makes it possible locally to increase the ejection angle of the air/fuel mixture sheet, thereby forming a local enlargement of said sheet that intersects the fuel sheet from an adjacent injection system.

In another embodiment of the invention, some of the bowls include two diametrically opposite angular sectors with orifices of smaller diameter and/or with no orifices.

With such a configuration, the fuel sheet formed at the outlet from each of these bowls has two diametrically opposite enlargements on either side of the axis of the bowl, which enlargements intersect the fuel sheets generated by the two injection systems situated on either side of the bowl.

The combustion chamber includes at least one spark plug mounted in an orifice in the outer wall, and the orifices in the bowl of the injection system situated closest to the spark plug are distributed and dimensioned in such a manner that the sheet of air/fuel mixture from said injection system presents another local enlargement intersecting the axis of the spark plug between the radially inner end of the spark plug and a point of the outer periphery of said bowl.

This additional enlargement of the sheet of fuel makes it possible to project the sheet of fuel locally closer to the inner end of the spark plug, thereby further facilitating ignition of the air/fuel mixture and the propagation of the flame.

The bowl situated closest to the spark plug may have orifices of diameter smaller than the other orifices of said bowl, said orifices of smaller diameter being formed over an angular sector of dimension and angular position that are predetermined in such a manner as to form the enlargement intersecting the axis of the spark plug.

The bowl situated closest to the spark plug may also have no orifices over an angular sector of size and position that are predetermined so as to form the enlargement intersecting the axis of the spark plug.

The above-mentioned angular sector(s) extend over about 20° to about 50°.

The invention also provides a turbine engine, such as an airplane turbojet or turboprop, including a combustion chamber as described above.

BRIEF DESCRIPTION OF THE SEVERAL VIEWS OF THE DRAWINGS

Other advantages and characteristics of the invention appear from reading the following description made by way of non-limiting example and with reference to the accompanying drawings, in which.

DETAILED DESCRIPTION OF THE INVENTION

Figure 1:
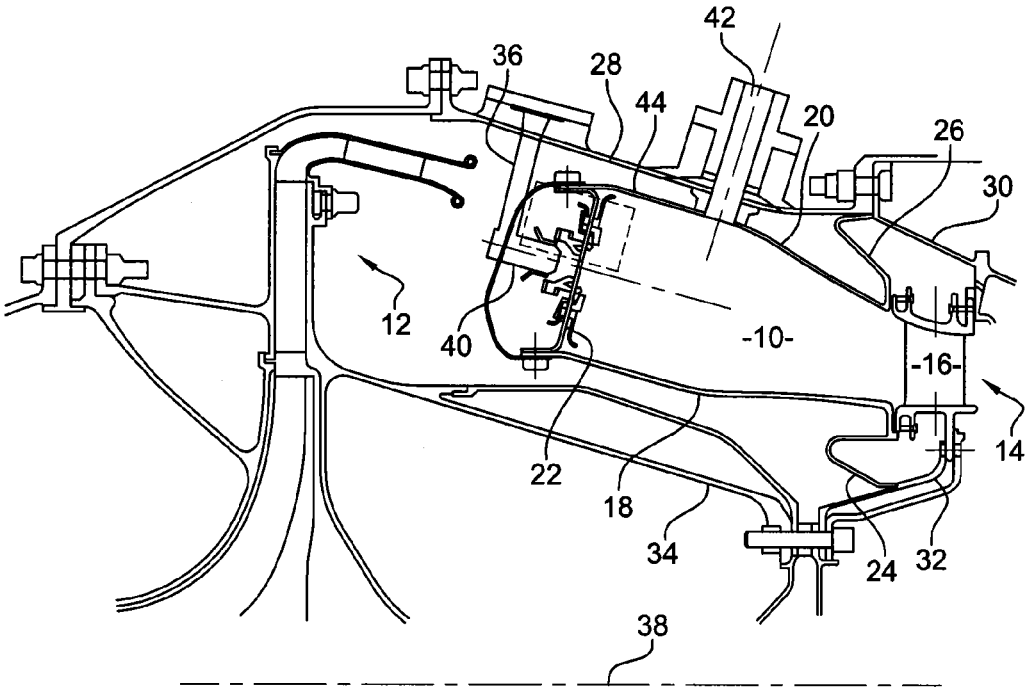
FIG. 1 is a fragmentary diagrammatic half-view in axial section of an annular combustion chamber of known type.

Reference is made initially to FIG. 1 which shows an annular combustion chamber 10 of a turbine engine such as an airplane turboprop or turbojet, the combustion chamber being arranged at the outlet from a centrifugal diffuser 12 mounted at the outlet from a high-pressure compressor (not shown). The combustion chamber 10 is followed by a high-pressure turbine 14 of which only the inlet nozzle 16 is shown.

The combustion chamber 10 has coaxial inner and outer frustoconical walls 18 and 20 forming surfaces of revolution that are arranged one inside the other and of section that tapers going downstream. Such a combustion chamber is said to be convergent. The inner and outer annular walls 18 and 20 are connected at their upstream ends to an annular chamber end wall 22 and they are fastened downstream via inner and outer annular flanges 24 and 26. The outer annular flange 26 bears radially outwards against an outer casing 28 and bears axially against a radial flange 30 for fastening the nozzle 16 of the high-pressure turbine to the outer casing 28. The inner annular flange 24 of the combustion chamber bears radially and axially against an inner annular part 32 for fastening the nozzle 16 to an inner annular wall 34.

The chamber end wall 22 has openings for mounting systems for injecting a mixture of air and fuel into the chamber, the air coming from the centrifugal diffuser 12 and the fuel being delivered by injectors 36.

The injectors 36 have their radially outer ends fastened to the outer casing 28 and they are regularly distributed along a circumference around the axis of revolution 38 of the chamber. At its radially inner end, each injector 36 has a fuel injection head 40 that is in alignment with the axis of a corresponding opening in the chamber end wall 22.

The mixture of air and fuel injected into the chamber 10 is ignited by means of at least one spark plug 42 that extends radially to the outside of the chamber 10. The inner end of the spark plug 42 extends through an orifice in the outer wall 20 of the chamber, and its radially outer end is fastened by appropriate means to the outer casing 28 and is connected to electrical power supply means (not shown) situated outside the casing 28.

The outer annular wall 20 of the combustion chamber has an annular row of primary orifices 44 for diluting the air/fuel mixture, which orifices are arranged upstream from the spark plug 42.

Figure 2:
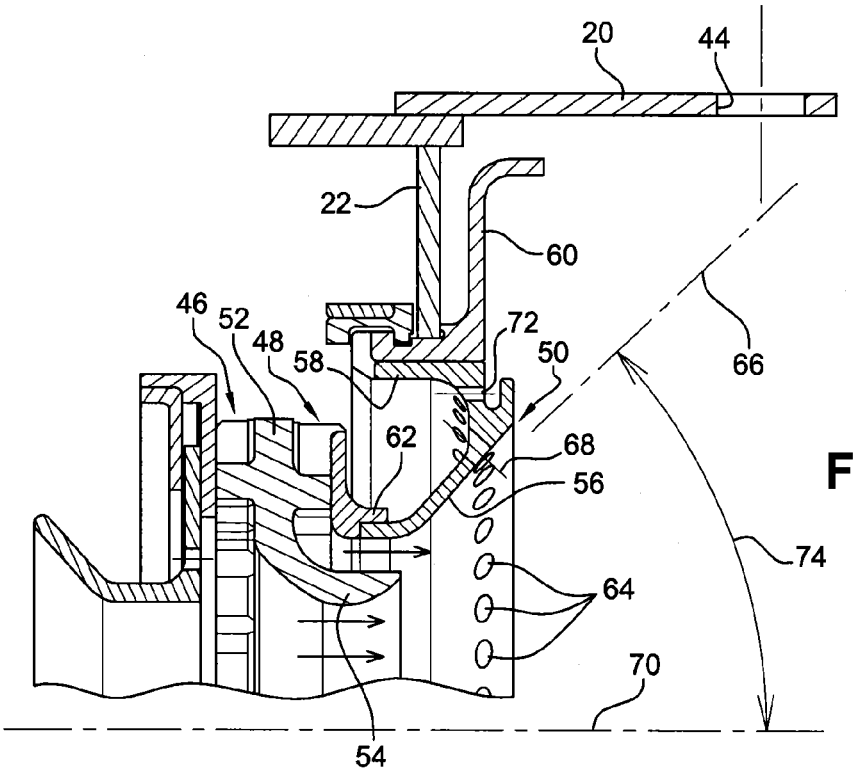
FIG. 2 is a fragmentary diagrammatic view on a larger scale of the zone marked in dashed lines in FIG. 1.

As can be seen more clearly in FIG. 2, each injection system has upstream and downstream swirlers 46 and 48 aligned on the same axis that are connected upstream to centering and guide means for the head of the injector, and downstream to a mixer bowl 50 that is mounted axially in the opening in the chamber end wall 22.

Each swirler 46, 48 comprises a plurality of vanes extending radially around the swirl axis and distributed regularly around this axis to deliver a rotating stream of air downstream from the injection head.

The swirlers 46 and 48 are separated from each other by a radial wall 52 connected at its radially inner end to a Venturi 54 that extends axially downstream inside the downstream swirler and that separates the flows of air from the upstream and downstream swirlers 46 and 48. A first annular air flow stream is formed inside the Venturi 54 and a second annular air flow stream is formed outside the Venturi 54.

The mixer bowl 50 has a substantially frustoconical wall 56 that flares downstream and it is connected at its upstream end to a cylindrical rim 58 extending upstream and mounted axially in the opening in the chamber end wall 22 together with an annular deflector 60. The upstream end of the frustoconical wall of the bowl is fastened via an intermediate annular part 62 to the downstream swirler.

The frustoconical wall 56 of the bowl has an annular row of air injection orifices 64 regularly distributed around the axis 70 of the bowl. The air passing through these orifices and the air flowing in the streams inside and outside the Venturi 54 become mixed with the fuel sprayed in by the injector so as to form a rotating sheet of a mixture of air and fuel that is of substantially frustoconical shape 66, flaring downstream. The axes 68 of each of the air injection orifices 64 of the bowl are inclined relative to the axis 70 of the bowl converging downstream towards said axis.

A second annular row of orifices 72 is formed at the junction between the upstream end of the cylindrical rim 58 and the frustoconical wall 56. These second orifices 72 serve to ventilate the downstream face of the deflector 60 and they limit the temperature rise of the chamber end wall 22.

In operation, the upstream and downstream swirlers 46 and 48 of the injection system impart rotation on the stream of air and sprayed fuel, while the air injection systems 64 in the frustoconical wall 56 of the bowl 50 impart shear to the air/fuel mixture. Thus, the greater the diameter of the air injection orifices 64 in the bowl 50, the greater the rate at which air passes through these orifices, thereby decreasing the aperture angle 74 of the frustoconical sheet of the air/fuel mixture.

In order to ensure circumferential propagation of the combustion flame between the injection systems, the configuration and the number of injection systems are determined so that the fuel sheets of adjacent injection systems intersect or cross in the circumferential direction upstream from the primary dilution orifices 44 so as to form a circumferentially continuous mist of air/fuel mixture.

Figure 3:
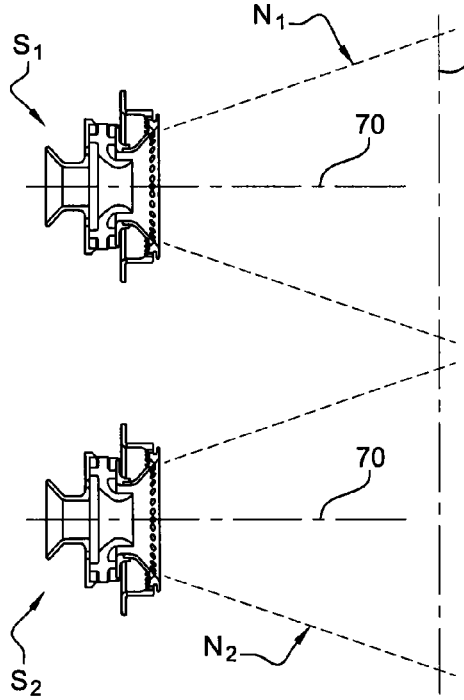
FIG. 3 is a diagrammatic side view of two injection systems in accordance with FIG. 2, and arranged side by side.
Figure 4:
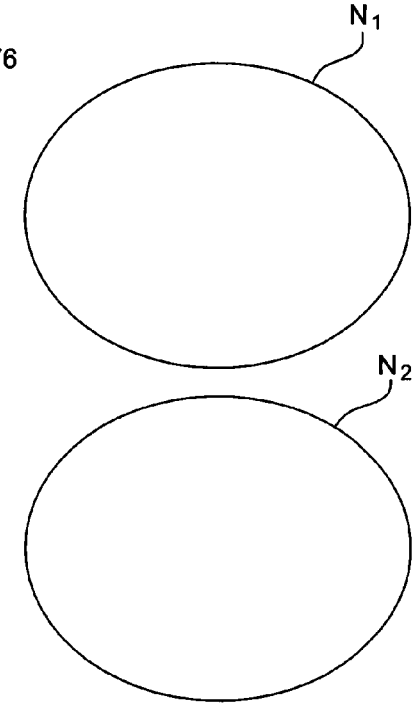
FIG. 4 is a diagrammatic view in cross-section of the sheets of fuel from the injection systems of FIG. 3.

FIG. 3 shows two adjacent injection systems S1 and S2 and the dashed lines show the frustoconical sheets of fuel as sprayed by the respective injection systems S1 and S2. FIG. 4 shows another pair of sheets of fuel N1 and N2 of the injection systems S1 and S2, respectively, in a transverse plane 76 containing the primary dilution orifices.

It can be seen that when the number of injection systems is reduced and the circumferential pitch between two adjacent injection systems S1 and S2 increases, the pitch becomes too great for the fuel sheets N1 and N2 to intersect circumferentially upstream from the primary dilution orifices, and that leads to difficulties in ensuring that the combustion flame propagates circumferentially.

In order to mitigate that drawback, it is not desirable to increase the aperture angle of the fuel sheets, since that would lead to a larger quantity of fuel being sprayed towards the inner and outer annular walls 18 and 20, thereby leading to hot points being formed on the inner and outer annular walls 18 and 20 of the combustion chamber. Nor is it desirable to increase the number of injection systems, since that would lead to making the turbine engine heavier and to increase in its fuel consumption.

The invention provides a solution to this problem, and also to the problems mentioned above, by distributing and dimensioning the orifices in the bowls of the injection systems in such a manner as to enlarge the fuel sheets locally in a circumferential direction so that, upstream from the primary dilution orifices, they intersect the sheets of fuel produced by the adjacent injection systems.

Figure 5:
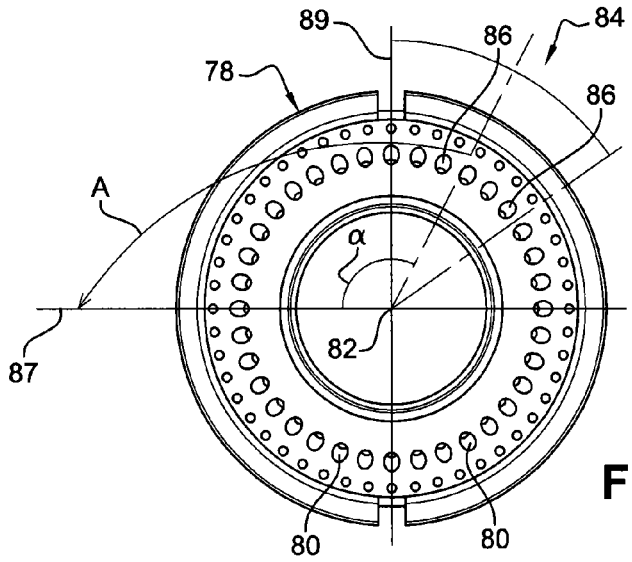
FIG. 5 is a diagrammatic view from downstream of a mixer bowl in a first embodiment of the invention.

In a first embodiment of the invention as shown in FIG. 5, the mixer bowl 78 seen from downstream has a plurality of orifices 80 that are regularly distributed around the axis 82 of the bowl. The bowl 78 has an angular sector 84 with orifices 86 of a diameter smaller than the diameter of the other orifices 80 in the bowl 78.

When the air/fuel mixture penetrates into the inside of the bowl 78, the flow rate of air passing through the orifices 86 in the sector 84 is smaller than the flow rate of air passing through the other orifices 80 of the bowl 78. As a result, the particles of air and fuel passing in the vicinity of this sector 84 of the bowl 78 leaves the bowl 78 on a path that is more flared than that of the particles passing in the vicinity of the other orifices 80 of the bowl 78. This leads to the sheet of sprayed fuel being enlarged locally.

As mentioned above, the sheet of the air/fuel mixture leaving each injection system is rotating because of the rotation imparted by the upstream and downstream swirlers. Thus, each particle of air and of fuel in the air/fuel sheet follows a path that is substantially helical and frustoconical. The local enlargement takes on a shape corresponding to these helical and frustoconical paths.

When the upstream and downstream swirlers produce a stream of air rotating counterclockwise on looking at the bowl from downstream, it can be understood that the sector 84 of the bowl 78 should be angularly offset by an angle $\alpha$ in the direction opposite to the direction of rotation of the air/fuel mixture, i.e. clockwise, relative to a plane 87 containing the axis 82 of the bowl 78 and perpendicular to a radial plane 89 containing the axis 82 of the bowl 78 and the axis of the combustion chamber. In FIG. 5, the planes 87 and 89 are represented by lines and they are perpendicular to the plane of the sheet. The angle $\alpha$ is measured from the middle of the sector of the bowl 78 containing the orifices 86 of smaller diameter. This angle $\alpha$ determines the position (arrow A) of the enlargement of the fuel sheet that will intersect circumferentially the fuel sheet from an adjacent injection system.

Figure 6:
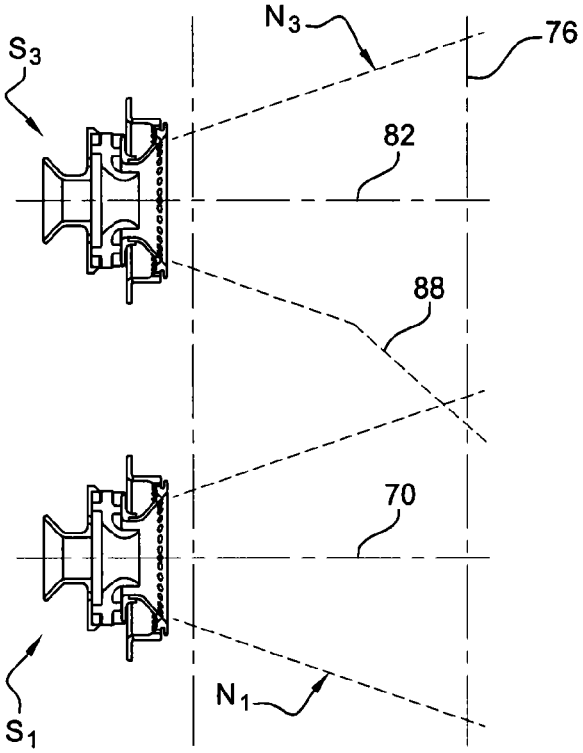
FIG. 6 is a diagrammatic side view of an injection system including a mixer bowl in accordance with FIG. 2 and an injection system including a mixer bowl of the invention as shown in FIG. 5.
Figure 7:
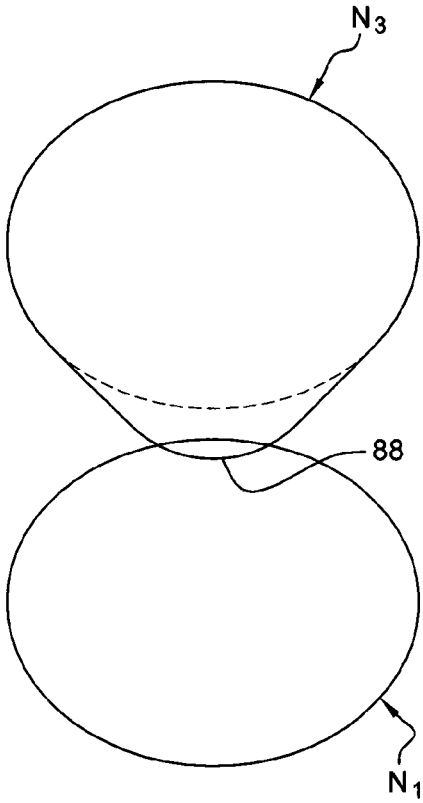
FIG. 7 is a diagrammatic view in cross-section of the sheets of fuel from the injection systems of FIG. 6.

FIG. 6 shows two adjacent injection systems, one of which, S1, is identical to that of the prior art described with reference to FIG. 3, and the other of which, S3, corresponds to the injection system described with reference to FIG. 5. The dashed lines show the frustoconical shapes of the fuel sheets N1 and N2 produced by each of the injection systems S1 and S3. The enlargement 88 of the fuel sheet N3 from the injection system S3 intersects the fuel sheet N1 from the injection system S1 circumferentially upstream from the primary air injection orifices. FIG. 7 is a section view through the fuel sheets N1 and N3 of the injection systems S1 and S3, respectively, in a transverse plane 76 containing the primary dilution orifices. In this figure, it can be seen that the local enlargement 88 of the sheet N3 of the air/fuel mixture from the injection system S3 intersects the sheet N1 from the injection system S1 circumferentially.

The angular extent of the sector 84 of the bowl 78 determines the angular extent of the enlargement around the axis 82 of the bowl 78.

Figure 8:
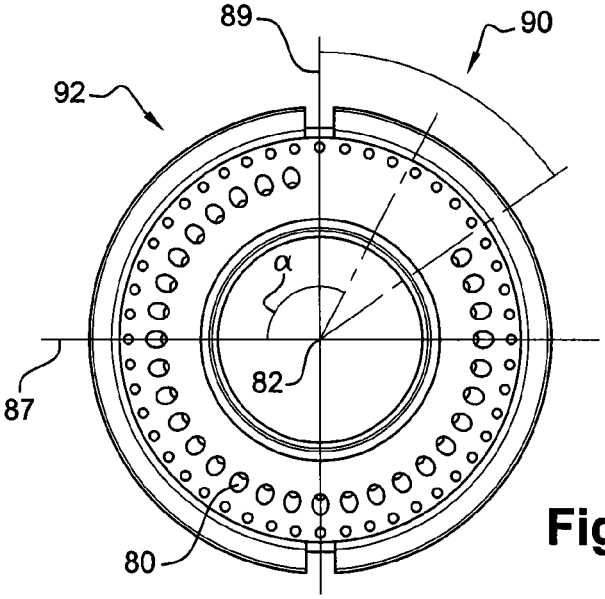
FIG. 8 is a diagrammatic view from downstream of a mixer bowl in a second embodiment of the invention.

In a second embodiment of the invention, the sector of the bowl having smaller-diameter orifices is replaced by a sector 90 having no air injection orifices, as shown in FIG. 8. This sector 90 without orifices is likewise offset by an angle $\alpha$ relative to the plane 87. Such a bowl 92 makes it possible to obtain a fuel sheet having substantially the same shape as that obtained with a bowl 78 having a sector 84 of smaller-diameter orifices 86. Only the width of the enlargement of the fuel sheet is greater because there is no flow of air passing through the sector 90 of the bowl 92.

In a practical implementation of the embodiment shown in FIGS. 5 and 8, the sector 84 of the bowl 78 having smaller-diameter orifices and the sector 90 of the bowl 92 having no orifices extends angularly over about 50° and the angle $\alpha$ is about 120°.

Figure 9:
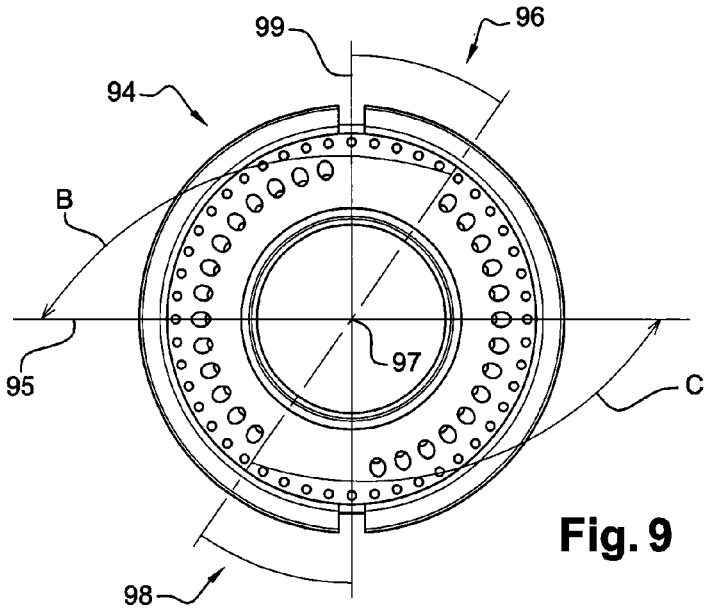
FIG. 9 is a diagrammatic view from downstream of a mixer bowl in a third embodiment of the invention.

In another embodiment of the invention as shown in FIG. 9, the mixer bowl 94 has two diametrically opposite angular sectors 96 and 98 that have no air injection orifices. Arrows B and C show the paths followed by the particles of air and fuel passing in the vicinity of the first and second sectors 96 and 98 of the bowl 94.

Figure 10:
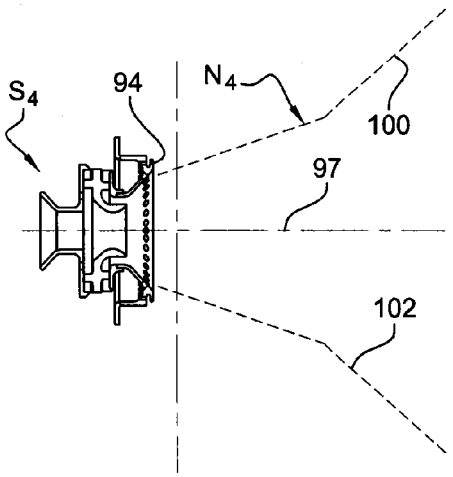
FIG. 10 is a diagrammatic side view of an injection system including the FIG. 9 mixer bowl of the invention.
Figure 11:
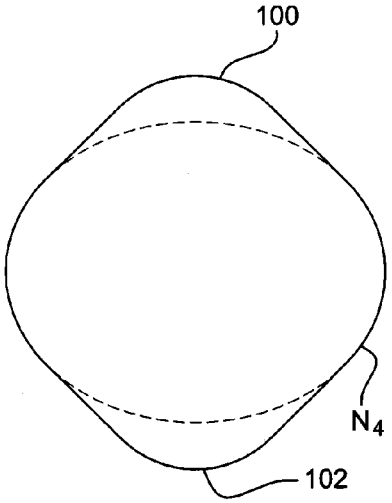
FIG. 11 is a diagrammatic cross-section view of the fuel sheet from the injection system of FIG. 10.

FIG. 10 shows an injection system S4 having a bowl 94 with two of the above-mentioned diametrically opposite sectors. The first and second sectors 96 and 98 of the bowl 94 serve to form a first enlargement 100 and a second enlargement 102 of the fuel sheet N4 (FIGS. 10 and 11). These first and second enlargements 100, 102 are diametrically opposite each other and they are for intersecting circumferentially the fuel sheets produced by the injection systems situated on either side of the bowl 94.

In a practical implementation of the FIG. 9 bowl, each sector 98, 96 extends angularly over about 20° to 30° and is angularly offset by an angle of about 100° in the opposite direction to the direction of rotation of the air/fuel mixture, i.e. clockwise, relative to a plane 95 containing the axis 97 of the bowl 94 and perpendicular to a radial plane 99 containing the axis 97 of the bowl 94 and the axis of the combustion chamber. In FIG. 9, the planes 95 and 99 are represented by lines and they are perpendicular to the plane of the sheet.

In a variant embodiment of the FIG. 9 bowl, the two diametrically opposite angular sectors may have orifices of smaller diameter. It is also possible for one of the sectors to have no orifices, while the other sector has orifices of smaller diameter.

Figure 12:
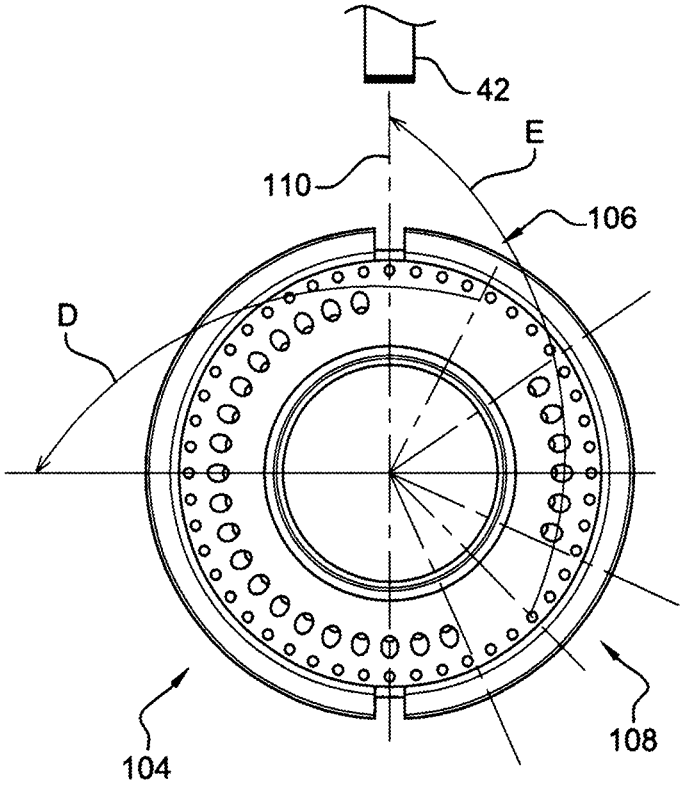
FIG. 12 is a diagrammatic view from downstream of a mixer bowl in a fourth embodiment of the invention.

In yet another embodiment of the invention as shown in FIG. 12, the mixer bowl 104 situated closest to the spark plug 42 has two angular sectors 106, 108 with no orifices, one of which sectors, 106, serves to form a first enlargement for intersecting circumferentially an adjacent fuel sheet, while the other enlargement, 108, serves to form a second enlargement for intersecting the axis 110 of the spark plug 42 between the inner end of the spark plug and a point of the outer periphery of the bowl 104.

The first and second enlargements are substantially located on the fuel sheet at 90° relative to each other. The arrows D and E show the paths followed by the particles of air and of fuel passing in the vicinity of the first and second sectors of the bowl 104.

The first angular sector 106 of the bowl 104 extends angularly over about 50°, and the second angular sector 108 for delivering fuel closer to the inner end of the spark plug 42 extends angularly over about 40°.

The injection system situated closest to the spark plug may also have two diametrically opposite sectors as described with reference to FIG. 10 for the purpose of circumferentially propagating the combustion flame, together with a third sector having no orifices or having orifices of small diameter for delivering fuel towards the spark plug.

In the above description, the direction of rotation of the swirlers is given by way of example and it could be understood that the operation would be similar for an air/fuel mixture rotating clockwise. Under such circumstances, only the angular positioning of the sectors of the bowls without orifices or with orifices of smaller diameter would need to be modified.

In practice, the positioning and the angular extent of the sector having orifices of smaller diameter or having no orifices is determined by three-dimensional simulation. Such a simulation takes account of numerous parameters such as the shape and the angle of inclination of the vanes of the swirlers the direction of rotation of the swirlers, the flow rate of air from the high pressure compressor, and the flow rate of fuel from the injectors, etc.

The mixer bowl of the invention makes it possible to obtain circumferential continuity for the air/fuel mixture between two injectors prior to air being introduced via the primary dilution orifices, thereby ensuring good circumferential propagation of the combustion flame when the number of injection systems is smaller and/or when the circumferential pitch between those systems is greater.

The invention claimed is:

1. An annular combustion chamber for a turbine engine, the chamber comprising:

two coaxial walls forming surfaces of revolution, of respectively an inner wall and an outer wall, the walls being connected together at upstream ends thereof by an annular chamber end wall including openings for mounting injection systems, each opening comprising at least one swirler for producing a rotating stream of air downstream from a fuel injector; and a bowl mounted in each of the openings, each bowl including a substantially frustoconical wall downstream from the swirler and formed with an annular row of air injection orifices for producing a substantially frustoconical and rotating sheet of a mixture of air and of fuel, wherein the outer wall includes an annular row of primary dilution orifices, and wherein the orifices of the bowls are distributed and dimensioned such that at least some of the sheets of air/fuel mixture present, in a radial cross-section, at least one local circumferential enlargement relative to another part of the respective sheet, the enlargement circumferentially intersecting an adjacent air/fuel sheet upstream from the primary dilution orifices.

2. A chamber according to claim 1, wherein the orifices of at least some bowls are regularly distributed around axes of the bowls, and some of the orifices of each of the bowls have a diameter smaller than other orifices of the bowls so that smaller-diameter orifices are formed over an angular sector of size and angular position that are predetermined to form the at least one local enlargement of the respective sheet of air/fuel.

3. A chamber according to claim 2, wherein the orifices of the angular sector of each bowl have a diameter that is at least 40% smaller than the diameter of the other orifices of the bowl.

4. A chamber according to claim 1, wherein at least some of the bowls have no orifices over an angular sector of size and angular position that are predetermined to form the at least one local enlargement of the sheet of air/fuel.

5. A chamber according to claim 2, wherein some of the bowls include two diametrically opposite angular sectors with at least one of orifices of smaller diameter and/or with and no orifices.

6. A chamber according to claim 1, further comprising a spark plug mounted in an orifice in the outer wall, and wherein the orifices in the bowl of the injection system situated closest to the spark plug are distributed and dimensioned such that the sheet of air/fuel mixture presents another local enlargement intersecting an axis of the spark plug between a radially inner end of the spark plug and a point of an outer periphery of the bowl.

7. A chamber according to claim 6, wherein the bowl situated closest to the spark plug includes orifices of diameter smaller than the other orifices of the bowl, the orifices of smaller diameter being formed over an angular sector of dimension and angular position that are predetermined to form the local enlargement intersecting the axis of the spark plug.

8. A chamber according to claim 6, wherein the bowl situated closest to the spark plug has no orifices over an angular sector of size and position that are predetermined to form the local enlargement intersecting the axis of the spark plug.

9. A chamber according to claim 2, wherein the angular sector extends over about 20° to about 50°.

10. A turbine engine, an airplane turbojet, or a turboprop, comprising a combustion chamber according to claim 1.

* * * * *